US006101942A

United States Patent [19]

Robert

[11] Patent Number: 6,101,942

[45] Date of Patent: Aug. 15, 2000

[54] PLATE REMOVING DEVICE INCLUDING A ROTATABLE SPINDLE CARRYING BIASED CLAMPING ELEMENTS

[75] Inventor: Müller Robert, Heuchelheim, Germany

[73] Assignee: Koenig & Bauer Aktiengesellschaft, Wurzburg, Germany

[21] Appl. No.: 09/284,232

[22] PCT Filed: Oct. 13, 1997

[86] PCT No.: PCT/DE97/02341

§ 371 Date: Aug. 12, 1999

§ 102(e) Date: Aug. 12, 1999

[87] PCT Pub. No.: WO98/16388

PCT Pub. Date: Apr. 23, 1998

[30] Foreign Application Priority Data

Oct. 12, 1996 [DE] Germany ..... 196 42 141

[51] Int. Cl.[7] ..... B41F 27/12

[52] U.S. Cl. ..... 101/415.1; 101/378

[58] Field of Search ..... 101/415.1, 378

[56] References Cited

U.S. PATENT DOCUMENTS

| | | | |
|---|---|---|---|
| 3,016,010 | 1/1962 | Luehrs | 101/415.1 |
| 5,461,981 | 10/1995 | Schneider | 101/415.1 |
| 5,483,891 | 1/1996 | Reichel | 101/415.1 |
| 5,651,315 | 7/1997 | Ruckmann et al. | 101/415.1 |
| 5,692,443 | 12/1997 | Reutter | 101/415.1 |

FOREIGN PATENT DOCUMENTS

| | | | |
|---|---|---|---|
| 0 453 794 | 10/1991 | European Pat. Off. . | |
| 0 732 203 | 3/1996 | European Pat. Off. . | |
| 43 03 381 | 2/1993 | Germany . | |
| 43 35 140 | 10/1993 | Germany . | |
| 44 15 622 | 5/1994 | Germany . | |
| 195 09 559 | 3/1995 | Germany . | |
| 195 09 562 | 3/1995 | Germany . | |
| 934718 | 8/1963 | United Kingdom | 101/415.1 |

*Primary Examiner*—Ren Yan
*Assistant Examiner*—Leslie J. Grohusky
*Attorney, Agent, or Firm*—Jones, Tullar & Cooper P.C.

[57] ABSTRACT

A cylinder of a rotary printing press has a plate end insertion slit which receives the angled ends of plates. A rotatable spindle is supported in a bore in the cylinder and carries a plurality of projections. These projections can function as plate end clamps. They also have hooks or protrusions which will engage edge positions of the plate ends to push the plate ends out of the cylinder slit.

5 Claims, 3 Drawing Sheets

PLATE REMOVING DEVICE INCLUDING A ROTATABLE SPINDLE CARRYING BIASED CLAMPING ELEMENTS

FIELD OF THE INVENTION

The present invention relates to a device for releasing plates from a cylinder of a rotary printing press. Beveled or angled ends of the plates are placed in a narrow insertion slit. Plate end clamping elements have protrusions which act as plate end ejections.

DESCRIPTION OF THE PRIOR ART

A plate cylinder with a device for lifting a printing plate is known from DE 43 03 381 A1. For this purpose, the plate cylinder has bores underneath the printing plate. These bores can be charged with compressed air for lifting the printing plate.

This prior art printing cylinder has a limitation in that elaborate compressed air feed lines are necessary.

DE 44 15 622 describes a device for fastening a plate on a plate cylinder. Here, a shaft with centrifugal force elements is provided for clamping, and a push-out edge for releasing the plate.

DE 195 09 562 C1 shows a device for releasing plates from a cylinder of a rotary printing press by means of a leaf-shaped lifter.

SUMMARY OF THE INVENTION

The object of the present invention is based on providing a device for releasing printing plates with beveled ends from a cylinder of a rotary printing press. At least one beveled end of the plate can be released from the cylinder using the device of the present invention.

In accordance with the present invention, this object is attained by using a plate end holder having a plurality of resilient clamping elements which press against a plate end inserted into a cylinder insertion slit. At least some of the clamping elements have a protrusion on their plate end engaging faces. These protrusions can engage a plate edge to push the plate end out of the insertion slit.

The advantages which can be achieved by the present invention reside, in particular, in that the release of a beveled edge of the plate from the surface of the plate cylinder takes place with the use of a generally known clamping device. The clamping device consists of a pivotable spindle which has hooks or projections in accordance with the present invention, on its circumference, which are engageable with an edge of and act on the trailing end of the plate. The end of the plate, which has been released from the surface of the plate cylinder by the turning of the spindle which carries the projections, therefore can be removed without further aids from the axial slit in the cylinder, for example. Moreover, no elements are arranged outside of the cylinder, or project past the surface of the cylinder. The hooks or projections of the device in accordance with the present invention move inside the slit receiving the ends of the plate, or respectively in a groove of the spindle. Therefore no additional space is required for the device in accordance with the present invention in the area of the surface of the cylinder. A surface of the plate, which can be maximally printed, remains and is not reduced, as would be the situation if bores or movable strips, for example, are arranged in the surface.

BRIEF DESCRIPTION OF THE DRAWINGS

A preferred embodiment of the present invention is represented in the drawings and will be described in greater detail in what follows.

Shown are in.

DESCRIPTION OF THE PREFERRED EMBODIMENT

Figure 1:
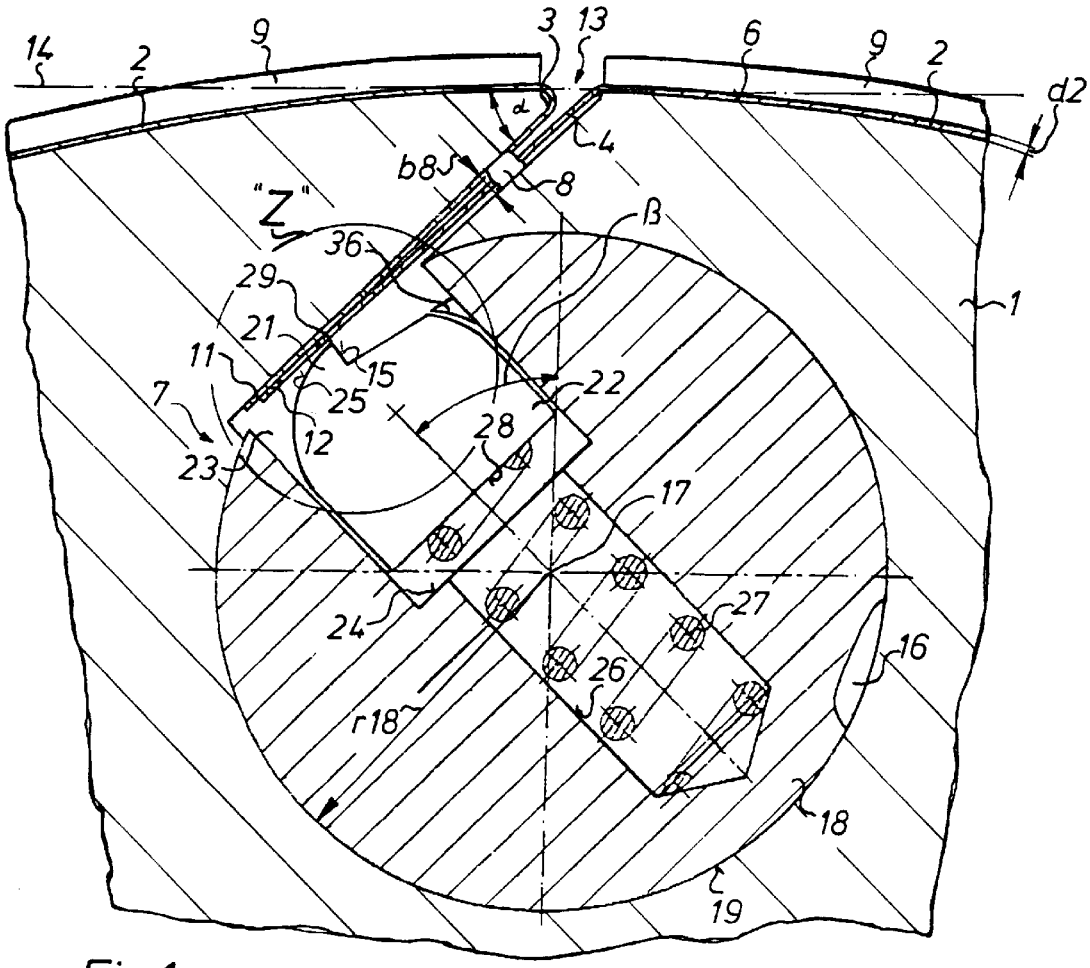
FIG. 1, a schematic representation of a cross section through a device in accordance with the present, invention in a clamping position.

For receiving flexible plates 2 with beveled ends 3, 4, a cylinder 1 of a rotary printing press is provided with at least one narrow plate end insertion slit 8 extending parallel in respect to an axis of rotation from a surface 6 of the cylinder 1 into its interior 7. This structure may be seen most clearly in FIG. 1.

The plates 2, which typically have a thickness d2, for example d2=0.2 to 0.3 mm, preferably are printing plates or support plates, for example with rubber blankets 9 fastened thereon. A leg 11 of the leading end 3 is longer, in the present example, than a corresponding leg 12 of the trailing end 4 of the plate 2.

The slit 8 is preferably designed to be rectangular in cross section. At its start 13 on the cylinder peripheral surfaces 6, a width b8 of the cross section of the slit 8 is of slightly more than twice the thickness d2 of the plate 2, i.e. b8=1 millimeter, for example. In relation to a tangent 14 adjacent to the cylinder peripheral surface 6 in the area of the slit 8, the slit 8 is inclined by an angle of inclination $\propto$, for example $\propto$=45°. The slit 8 terminates in a recess or bore 16 in cylinder 1 extending parallel with the slit 8. The recess or bore 16 has the shape of a cylindrical bore 16. The bore 16 is connected with the slit 8. A lever 18, which is pivotable around its longitudinal axis 17, or a pivotable holder 18 or spindle 18, is arranged in this bore 16. A spindle 18, which is provided with a known drive, is used in the present preferred embodiment.

The spindle 18, which is provided with a radius r18, for example r18=15 mm, is seated pivotably and centered in the bore 16.

Figure 2:
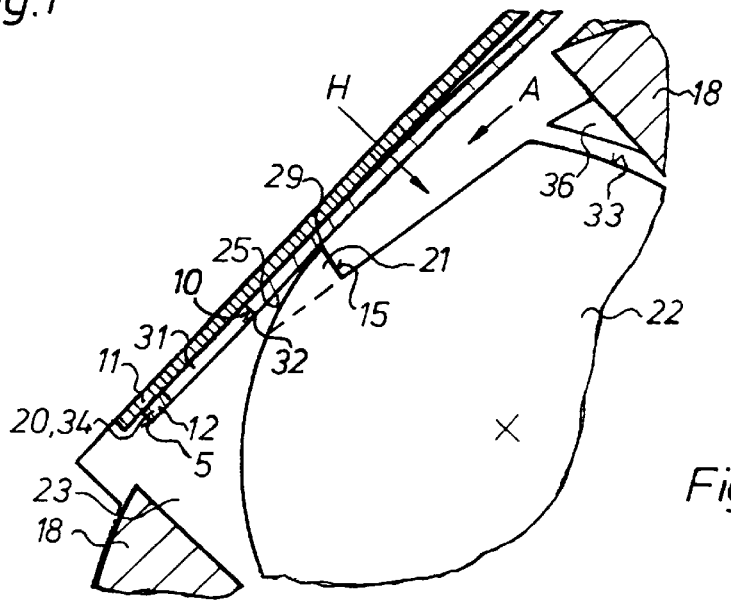
FIG. 2, a detail "Z" in FIG. 1, with an enlarged representation of a hook in the clamping position.
Figure 3:
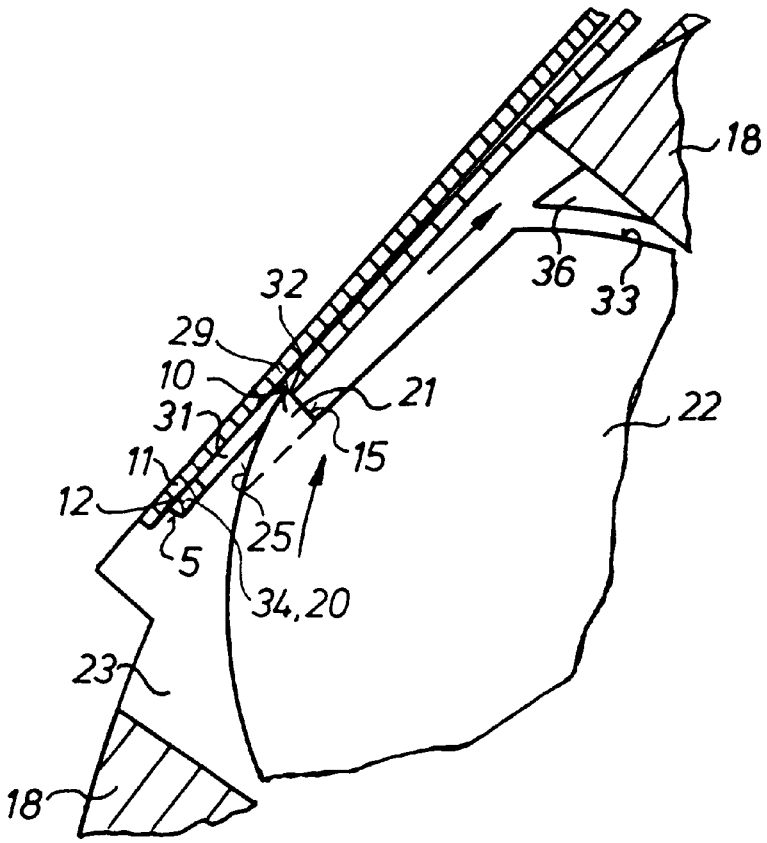
FIG. 3, a corresponding representation in accordance with FIG. 2 with a hook in the release position.
Figure 4:
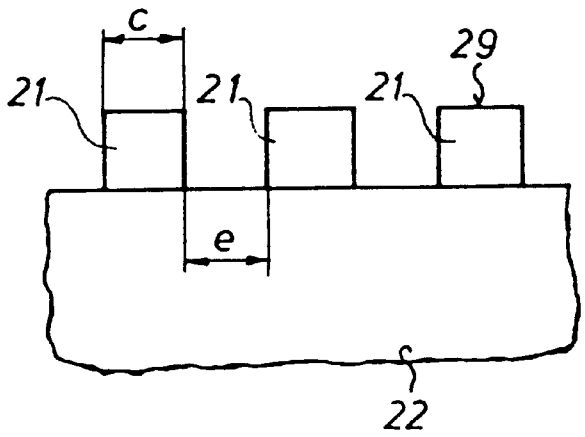
FIG. 4, a plan view A in accordance with FIG. 2 of a hook strip, but without showing the beveled legs of the plate; and in FIG. 5, a plan view H in accordance with FIG. 2 of a further embodiment variation.

On its circumference 19, this spindle 18 has a groove 23 of rectangular cross section, for example, which extends in the axial or radial direction, or also along a secant of the spindle 18 as see in FIGS. 1, 2 and 3. At least a single push-out or plate end ejector strip 22 for each width of the plate, or several short push-out strips 22 for each width of the plate, are arranged in this groove 23. In the center and lower portion of their cross section, these push-out strips 22 are matched to the groove 23, so that they can be easily radially moved inside it, and on their side facing the slit 8 they have one or more axially extending projections 21 or hooks 21, which extend in a direction parallel to an axis of the spindle 18 and which are spaced apart from each other. The hooks 21 each have a length c of; for example 60 mm, or respectively 10 mm, and a distance e of for example 10 mm, from each other, as shown in FIG. 4.

Blind bores 26, which are spaced apart from each other in the axial direction of the spindle 18, are located in the bottom surface 24 of the spindle groove 23. A pressure spring 27 is arranged in each blind bore 26. Each pressure spring 27 is supported on the bottom of the blind bore 26 and its point of application of force acts in the radial, or respectively parallel direction of the spindle 18 against the underside 28 of the push-out or plate end ejector strip 22. In this way, in the clamped position of the plate 2, the projections 21 are pushed with at least their front edge 29 against the legs 12, 11 inserted into the slit 8, by means of which the legs 11, 12 are fixed in place against the cylinder 1, as may be seen by referring to FIGS. 1 and 2.

If a plate 2 on the cylinder 1 is to be released, the spindle 18 is rotated, for example counterclockwise, as seen in FIG. 1, in the direction of the free ends of the beveled legs 11, 12 until, because of the spring action, the front or plate end push-out faces 15 of the projections 21 engage recesses 31, each formed with a recess front face 10, with each such recess being located at the end of the leg 12 of the trailing plate end 4, or act on a plate end front face 5 situated at the end 20, 34 of the trailing plate end leg 12. If the plate end is perforated, a recess 31, for example a rectangular recess 31, in the leg end 20, 34, is assigned to each projection 21.

Each of the projections 21, with the push-out faces 15, grip an upper edge 32 at the front face 10 of each of the recesses 31, or a front face 5 of the end 20, 34 of the shortened leg 12, from behind. By turning the spindle 18 in a clockwise direction—in the preferred embodiment - now the trailing end 4 of the plate 2 is pushed sufficiently far in the direction toward the start 13 of the slit 8, so that, because of the rotating movement of the spindle 18, the front edges 29 and the push-out face 15 of the protrusions 21 come out of engagement with the edges 32 at the front faces 10 of the recesses 31, or respectively with the end 20, 34 of the front face 5 of the shortened leg 12. In the course of this, the trailing plate end 4 is already moved out of the slit 8, and the end 4 of the plate 2 is lifted off the peripheral surface 6 of the cylinder 1 sufficiently far so that it is now possible to easily remove the plate 2 manually or by means of generally known plate removal devices.

The push-out strip 22 can be moved by the spring force of spring 27 in the radial direction of the groove 23 until with a portion of its periphery 33 it encounters a stop 36, fixed on the spindle, in the groove 23.

By turning the spindle 18 in a clockwise direction, as seen in FIG. 1 in the preferred embodiment, the protrusions 21 are brought into a plate insertion position (not represented) inside the bore 16 and below the slit start 13. An angle of rotation $\beta=45°$, for example, between the clamping position and the insertion position of the spindle 18 is sufficient.

The projections 21 of the push-out strip 22 can be, as viewed in the axial direction, continuous or can be spaced apart from each other.

Several short push-out strips 22 can be provided in the groove 23, which are arranged axially directly next to each other or which are spaced apart from each other.

With push-out strips 22 spaced apart from each other, several clamping elements G are provided in the axial direction. In this case, push-out strips 22 with protrusions, or respectively hooks, are arranged between them.

The cross section of the clamping elements G can be arbitrary, for example rectangular, circular, rectangular with round stars, or in the shape of a stepped half disk, etc.

Figure 5:
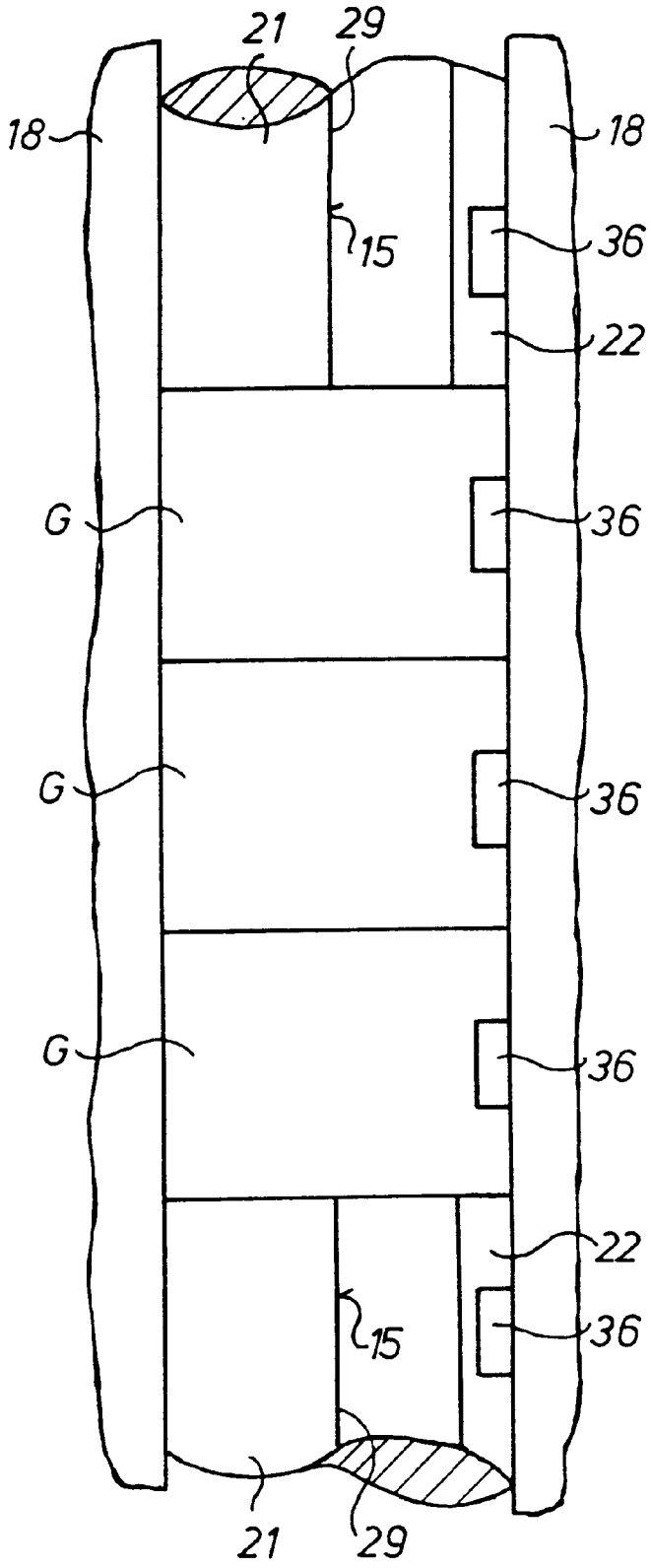

The number of push-out strips 22 with hooks 21 is less than the number of clamping elements G, for example in a ratio of one to two or one to four. Push-out strips 22 and clamping elements G can have the same length, for example of 60 mm. An arrangement of push-out strips 22 and clamping elements G is shown in FIG. 5.

Push-out strips 22 with hooks or protrusions 21 and clamping elements G are resiliently seated in a radial direction or in a direction of a secant of the spindle 18, as represented in FIG. 1. While the elements G provide a permanent clamping of the two legs 11, 12 against the wall of the cylinder 1 which laterally delimits the slit 8, the push-out strips 22, provided with hooks 21, grip edges 31 and front faces 10, as seen in FIG. 3 that are located in recesses in the leg 12 from behind, when the spindle 18 is turned back in a counterclockwise direction. By turning the spindle 18 in a direction opposite the clamping direction, i.e. in a clockwise direction, the leg 12 of the plate 2 is moved in the direction toward the slit start 13. The end 4 of the plate 2 can be pulled out of the slit 8 because of this movement.

It is also possible for the push-out strips 22 provided with hooks 21 to grip the end 20, 34 at the front face 5 of a shortened leg 12 from behind. In this case, appropriate recesses 31 in the leg 12, which are assigned to the hooks, or respectively projections 21, are omitted. The stops 36 are provided opposite the protrusions 21, for example in the upper part on the inside of the groove 23. Their contour is matched to the contour of the hooks 21, or respectively to the contour of the clamping elements G. They are intended to constitute a radial limitation of the movement of the hooks 21, or respectively of the clamping elements G in the direction toward the insertion slit 8. In the preferred embodiment, the upper portion of the push-out strip 22 with the protrusions, or respectively hooks 21 has the shape of a stepped half disk in cross section.

While a preferred embodiment of a plate removing device in accordance with the present invention has been set forth filly and completely hereinabove, it will be apparent to one of skill in the art that a number of changes in, for example, the type of plate being held, the type of cylinder and the like could be made without departing from the true spirit and scope of the present invention which is accordingly to be limited only by the following claims:

What is claimed is:

1. A device for clamping and for releasing plates with beveled plate ends from a cylinder of a rotary printing press, said device comprising:

a cylinder body;

a cylinder body peripheral surface;

a plate end insertion slit extending into said cylinder body from said cylinder body peripheral surface;

a cylinder bore in said cylinder body, said cylinder bore extending generally parallel to an axis of rotation of said cylinder body, said plate end insertion slit terminating in said cylinder bore;

a spindle supported for rotation in said cylinder bore, said spindle being rotatable in first and second opposing directions;

a plurality of plate end clamping elements resiliently supported in said spindle for radial movement with respect to said spindle, said plurality of plate end clamping elements being engageable with beveled plate ends when the beveled plate ends are inserted in said plate end insertion slit, the beveled plate ends each also having a front face;

means biasing said plurality of plate end clamping elements radially outwardly in said spindle; and a projection on each one of at least some of said plurality of clamping elements, each said projection having a projection plate clamping edge and a projection plate push-out faces each said projection being biased by said biasing means to a first position in which said plate clamping edge is engageable with a beveled plate end to hold the beveled plate ends in said plate end insertion slit when said spindle is rotated in said first direction, each said projection being biased by said biasing means to a second position in which said projection plate push-out face is engageable with a front face of a beveled plate end to push the beveled plate end out of said plate end insertion slit when said spindle is rotated in said second direction.

2. The device of claim 1 further including an axial groove in said spindle and wherein said clamping elements are arranged in said axial groove in said spindle.

3. The device of claim 2 further including a clamping strip extending the length of said groove and wherein said clamping elements are formed on said clamping strip.

4. The device of claim 1 wherein each of said clamping elements has a round cross-section.

5. The device of claim 1 wherein each of said clamping elements has an end surface in the form of a stepped half-disk facing said plate end insertion slit.

* * * * *